US006185746B1

(12) United States Patent
Scott

(10) Patent No.: US 6,185,746 B1
(45) Date of Patent: Feb. 13, 2001

(54) ATHLETIC SCHEDULE SHIRT FOR RECORDING ATHLETIC EVENTS

(76) Inventor: Mary Colleen Scott, 908 NE. Karapat Dr., Kansas City, MO (US) 64155

( * ) Notice: Under 35 U.S.C. 154(b), the term of this patent shall be extended for 0 days.

(21) Appl. No.: 09/391,574

(22) Filed: Sep. 8, 1999

(51) Int. Cl.[7] ..... A41B 1/00
(52) U.S. Cl. ..... 2/115; 2/69; 40/586; 273/244.1
(58) Field of Search ..... 2/115, 69, 77, 2/83, 249; 40/586; 273/244.1; 473/451; 283/48.1, 49

(56) References Cited

U.S. PATENT DOCUMENTS 565,141 * 8/1896 McElroy ..... 473/451
4,164,910 * 8/1979 Feiler ..... 116/225
4,354,282 * 10/1982 Langdon ..... 2/115
4,557,215 * 12/1985 Petersson ..... 116/222
4,710,981 * 12/1987 Sanchez ..... 2/115
5,052,056 * 10/1991 Braun ..... 2/115
5,379,461 * 1/1995 Wilmers ..... 2/115
5,556,135 * 9/1996 Duncan ..... 283/48.1
5,581,815 * 12/1996 Hans ..... 2/244

* cited by examiner

*Primary Examiner*—John J. Calvert
*Assistant Examiner*—Katherine Moran
(74) *Attorney, Agent, or Firm*—Shook, Hardy & Bacon L.L.P.

(57) ABSTRACT

The present invention provides a shirt with a display of the upcoming schedule of an athletic team, wherein the display has blanks or fields that the wearer or shirt owner individual can fill in after each event to record information such as the winner and loser of the event, the final score, and the cumulative won/lost record of the chosen team. The information is recorded on the shirt using a washable, non-bleeding ink marker. Thus, the invention allows individuals to customize the shirt display after each event and wear the shirt throughout the season. At the conclusion of the season, the shirt can continued to be worn, or is suitable for framing.

12 Claims, 2 Drawing Sheets

ATHLETIC SCHEDULE SHIRT FOR RECORDING ATHLETIC EVENTS

STATEMENT REGARDING FEDERAL-SPONSORED RESEARCH OR DEVELOPMENT

Not applicable.

CROSS REFERENCE TO RELATED APPLICATIONS

Not applicable.

BACKGROUND OF THE INVENTION

This invention relates to a customizable display and a method of monitoring the progress of an athletic team. More particularly, this invention relates to a display and method wherein an individual records results of preselected athletic events within a representation of an athletic schedule displayed on a garment such as a shirt.

Each year, a large number of shirts commonly called T-shirts and sweat shirts are provided with athletic team insignias and logos. Generally, the insignias and logos are provided on the back or the front of the shirt, and sometimes on both. Such shirts are popular, in part, because they allow the wearer to show support for an athletic team of his or her choosing. These shirts are neither designed nor intended to allow an individual to update the shirt throughout the season or to participate in creating the eventual end product.

It is also common for individuals to monitor the number of events won or lost by athletic teams throughout a given season. At the conclusion of a season, if the team has achieved a high degree of success, posters and other memorabilia are sometimes printed with the season's schedule and the outcome of the listed events. Such memorabilia is historical, and is not intended to be worn by an individual throughout an athletic season.

The present invention provides a shirt with a display of the upcoming schedule of an athletic team, wherein the display has blanks or fields within which an individual can record information such as the winner and loser of the event, the final score, and the cumulative won:loss record of a preselected athletic team. The information is recorded on the shirt using a washable, non-bleeding ink marker. Thus, the invention allows an individual to customize the shirt display after each event and wear the shirt throughout the season. At the conclusion of the season the shirt can be worn, or is suitable for framing or other manner of display.

SUMMARY OF THE INVENTION

Thus, the present invention is designed to provide a shirt having a customizable display, wherein the display includes the season schedule of an athletic team and further includes fields in which an individual can print information from each event listed in the schedule, thereby following the progress of the team throughout the season. At the end of the season, the shirt has a complete record of the team's season and can either be worn, framed or otherwise displayed.

Accordingly, an object of the present invention is to provide a novel method of monitoring and recording the progress of an athletic team throughout an athletic season.

A further object of the present invention is to provide a shirt that has a customizable display on which an individual can write information relating to each athletic event of a season.

Yet another object of the present invention is to provide a customized shirt that, at the end of an athletic season, is suitable for framing.

Yet another object of the present invention is to provide a kit that includes a shirt, a customizable decal and a washable, non-bleeding ink marker.

Another object of the present invention is to provide a kit that includes a shirt having a customizable display and a washable, non-bleeding ink marker.

Other and further objects of the invention, together with the features of novelty pertinent thereto, will appear in the course of the following description.

BRIEF DESCRIPTION OF THE DRAWINGS

In the accompanying drawings which form a part of the specification and are to be read in conjunction therewith and in which like reference numerals are used to indicate like parts.

DETAILED DESCRIPTION OF THE INVENTION

Figure 1:
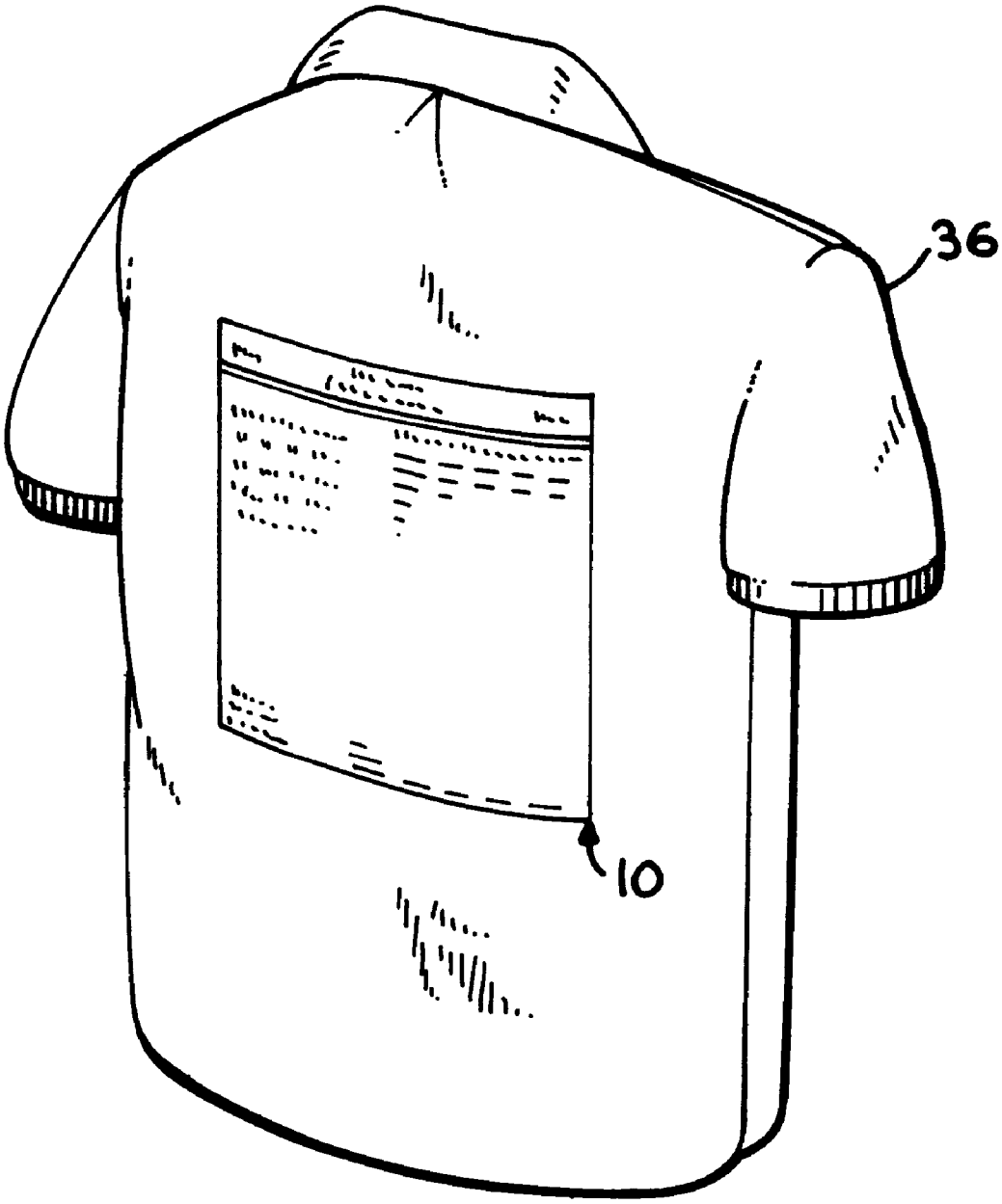
FIG. 1 is a view of the customizable display on a shirt.

Referring to FIG. 1 of the drawings, there is illustrated a planar, rectangular display 10 that is adapted to be screen printed, or provided on a substrate and sewn or heat transferred onto the back of a shirt 36. It should be understood that the invention is not limited to use of a shirt, and that other items may be substituted therefor.

Figure 2:
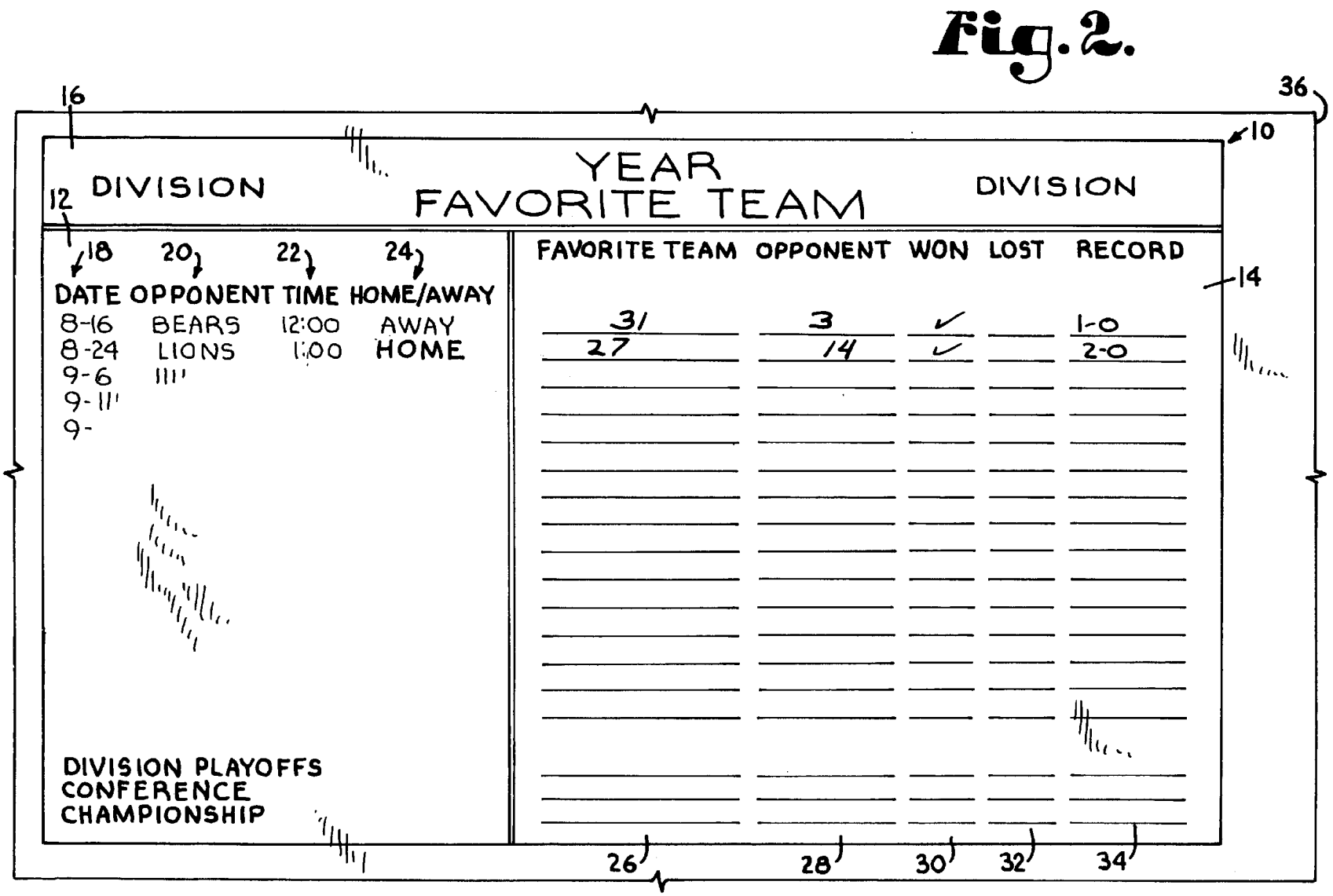
FIG. 2 is a front view of the customizable display of the present invention.

FIG. 2 illustrates in detail display 10 that includes a schedule section 12, a record section 14 and a heading section 16. Schedule section 12 contains the season schedule for a preselected athletic team and is organized in the following corresponding columns: column 18 lists the event dates in the schedule; column 20 lists the opponent; column 22 lists the event time; and, column 24 lists indications of the event location such as "home" or "away." The selected team can be in any team sport such as football, baseball, hockey, and the like. Also, individual sports such as automobile racing and skiing are adaptable to the present invention. The preceding sports are merely illustrative and not exclusive.

Record section 14 is adjacent to schedule section 12 and contains columns having blanks or fields for information regarding each scheduled event. Preferably, record section 14 includes the following columns: column 26 is for the selected team's score; column 28 is for the opponent's score; column 30 indicates a selected team's victories; column 32 indicates the selected team's losses; and column 34 is for the selected team's cumulative won:loss record. A field is provided in display 10 for the final won:loss record at the conclusion of the season. Such a field can be located at various positions on display 10, and preferably is at the end of column 34.

Heading section 16 includes the name of the selected team, the year of the athletic season displayed in schedule section 12, and an indication of the selected team's league or conference. Alternatively, the heading section 16 can include the selected team's logo or trademarks.

In practice, after each event listed in schedule section 12, or at the conclusion of the season, the owner of the shirt can record information from the conclusion of the events in the fields provided in record section 14. Preferably, the information is recorded with a washable, non-bleeding ink marker suitable for use with fabrics. Such markers are readily available.

As shown in FIG. 2, display 10 is placed on the back of a shirt 36. Although a shirt is the preferred item for carrying display 10, the present invention is adaptable for use with other articles of clothing or fabrics.

By enabling addition of information after each event, the display can be customized to present a complete record of a team's performance as the season progresses. Because the record section 14 is marked with washable, non-bleeding ink, the customized shirt can be worn throughout the season. After the season conclude's, the shirt can be framed, displayed, or worn.

It may be desirable to market the present invention as a kit that contains the materials needed to practice the invention. Specifically, the kits would include a shirt that already has a display attached as described above. Alternatively, the kit could contain a shirt and a display to be attached to the shirt, such as by heat transfer or stitching. In either case, the kit would also include a washable, non-bleeding ink marker.

From the foregoing, it will be seen that this invention is one well adapted to attain all ends and objects here and above set forth, together with other advantages which are obvious and which are inherent to the structure.

It will be understood that certain features and subcombinations are of utility and may be employed without further reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

I claim:

1. A shirt having an image affixed thereto, said image comprising:

a schedule section displaying the events in an athletic season which an athletic team is scheduled to participate; and a record section having an area for recording an outcome of each event, wherein the record section can be marked with information pertaining to the results of the events listed in the schedule section.

2. The shirt of claim 1, wherein the schedule section further comprises a first section listing a date for each event and a second section listing an opponent of the preselected athletic team for each event.

3. The shirt of claim 2, wherein the schedule section further comprises a third section listing a time for each event.

4. The shirt of claim 3, wherein the schedule section further comprises a fourth section containing indicia denoting a location of each event.

5. The shirt of claim 1, wherein the image is fixed to the shirt by a screen printing process.

6. The shirt of claim 5, wherein said a first color dye and a second color dye are used in the screen printing process.

7. A shirt having an image affixed thereto, said image comprising:

a schedule section displaying the events in an athletic season which an athletic team is scheduled to participate, wherein said schedule section further comprises a first section listing a date for each event, a second section listing an opponent of the preselected athletic team for each event; a third section listing a time for each event; and a fourth section containing indicia denoting a location of each event; and a record section having an area for recording an outcome of each event, wherein the record section can be marked with information pertaining to the results of the events listed in the schedule section, wherein said record section further comprises a first section for recording a score of the preselected athletic team after each event and a second section for recording a score of an opponent after each event.

8. The shirt of claim 7, wherein the record section further comprises a third section for indicating a winning outcome by the athletic team and a fourth section for indicating a losing outcome by the athletic team.

9. The shirt of claim 8, wherein said record section comprises a fifth section for recording a cumulative won:loss record of the preselected athletic team.

10. A shirt having an image affixed thereto, said image comprising:

a schedule section displaying the events in an athletic season which an athletic team is scheduled to participate;

a heading section including the name of the preselected athletic team and the year of the athletic season displayed in the schedule section; and a record section having an area for recording an outcome of each event, wherein the record section can be marked with information pertaining to the results of the events listed in the schedule section.

11. The shirt of claim 10, wherein the heading section further comprises a reference to a league of the preselected athletic team.

12. The shirt of claim 10, wherein the heading section further comprises a reference to a logo of the preselected athletic team.

* * * * *